US005460313A

United States Patent [19]

Magnusson et al.

[11] Patent Number: 5,460,313

[45] Date of Patent: Oct. 24, 1995

[54] STAPLER

[75] Inventors: Lars-Inge Magnusson; Olle Strååt, both of Hestra; Trygve Gustafsson, Åsenhöga, all of Sweden

[73] Assignee: Isaberg AB, Hestra, Sweden

[21] Appl. No.: 318,601

[22] PCT Filed: Feb. 26, 1993

[86] PCT No.: PCT/SE93/00166

§ 371 Date: Oct. 6, 1994

§ 102(e) Date: Oct. 6, 1994

[87] PCT Pub. No.: WO93/20980

PCT Pub. Date: Oct. 28, 1993

[30] Foreign Application Priority Data

Apr. 16, 1992 [SE] Sweden ..... 9201231

[51] Int. Cl.[6] ..... B27F 7/36

[52] U.S. Cl. ..... 227/8; 227/131

[58] Field of Search ..... 227/8, 131, 129, 227/120, 155

[56] References Cited

U.S. PATENT DOCUMENTS 4,623,082 11/1986 Kurosawa ..... 227/131
4,726,505 2/1988 Okazaki ..... 227/131
5,195,671 3/1993 Shimomura et al. ..... 227/120
5,230,457 7/1993 Hiroi et al. ..... 227/131

FOREIGN PATENT DOCUMENTS 0322906 7/1989 European Pat. Off. .
2940942 5/1980 Germany .

*Primary Examiner*—Scott A. Smith
*Attorney, Agent, or Firm*—Shapiro and Shapiro

[57] ABSTRACT

A stapler for driving staples into a sheaf of papers comprising a base, a stapler head pivotably connected to the base via a first pin and pivotable between a starting position and a working position in which it is applied against a sheaf of papers placed between the base and the stapler head. A reciprocating drive element, adapted to drive a staple into the sheaf of papers during a driving stroke, is arranged in the stapler head. An operating mechanism, adapted to drive the drive element, is pivotably connected to the stapler head via a second pin parallel to the first pin. A drive mechanism is arranged in the base for pivoting the stapler head and the operating mechanism. A locking mechanism is arranged in the stapler head for releasably locking the stapler head in a working position while a staple is being driven into the sheaf of papers.

5 Claims, 8 Drawing Sheets

STAPLER

BACKGROUND OF THE INVENTION

The present invention relates to a stapler for driving staples into an object, such as a sheaf of papers, said stapler comprising a base, a stapler head pivotably connected to the base via a first pin and pivotable between a starting position and a working position in which it is applied against said object when this is placed in the stapler between the base and the stapler head, a reciprocating drive element disposed in the stapler head and adapted to drive a staple into said object during a driving stroke, an operating means which is pivotable about a second pin parallel to the first pin and which is adapted to reciprocate the drive element, and a drive means adapted to pivot the stapler head and the operating means.

A prior-art stapler of this type is schematically illustrated in FIG. 1 of the accompanying drawings.

The illustrated stapler, which is adapted for driving staples into a sheaf of papers, comprises a base 1 and a stapler head 2 pivotably connected thereto. The stapler head 2 is pivotable about a pin 3, fixedly connected to the base 1, between an upper starting position (see FIG. 1) and a working position in which it is applied against a sheaf of papers 4 placed in the stapler between the base 1 and the stapler head 2 and which thus depends on the thickness of the sheaf of papers 4.

An operating means in the form of a pivotable arm 5 is arranged in the stapler head 2. The arm 5 is pivotable about a pin 6 which is parallel to the pin 3 and, like the latter, connected to the base 1. A reciprocating drive element 7, which is arranged in the stapler head 2 in order, during a driving stroke, to expel a staple from a staple magazine 8 arranged in the stapler head 2 and drive the staple into the sheaf of papers 4, is reciprocated by means of the arm 5. To this end, the arm 5 is pivotable between an upper starting position (see FIG. 1) and a lower position in which it is so placed that the drive element 7 has reached the base 1 or, to be more precise, is at a distance from the base 1 that equals the thickness of two sheets of paper, i.e. the thinnest imaginable sheaf to be stapled. The arm 5 is pivoted by a motor-driven eccentric device.

The arm 5 is connected to the stapler head 2 by a spring 9. When the arm 5 is pivoted downwards from the starting position, it entrains, owing to the spring 9, the stapler head 2 until this is applied against the sheaf of papers 4 which, in the example shown in FIG. 1, is much thicker than the smallest imaginable sheaf comprising two sheets of paper. When the stapler head 2 has been stopped by the sheaf of papers 4, the arm 5 continues to move downwards against the action of the spring 9. During this continued downward movement, the arm 5 imparts a driving stroke to the drive element 7, and a staple (not shown) is expelled from the magazine 8 and driven into the sheaf of papers 4.

When the staple has been fully driven into the sheaf of papers 4, the motor-driven eccentric device strives to continue to pivot the arm 5 to its lower position. This is, however, prevented by the sheaf of papers 4 which stops the drive element 7, and consequently the arm 5. This results in a lifting force acting on the pin 6 of the arm 5. To make the stapler work, this pin is therefore connected to the base 1 by a spring 10. Instead of being pivoted further downwards towards the base 1 at its front end, the arm 5 is thus raised against the action of the spring 10 at its rear end. The spring 10 has to be so strongly biased that it does not yield to the staple-driving force, which may be considerable when the sheaf of papers 4 is thick, and permits the pin 6 to be raised before the staple has been fully driven into the sheaf of papers.

The thicker the sheaf of papers 4, the stronger the spring force exerted by the springs 9 and 10 and the stronger the staple-driving force that the arm 5 has to overcome. Thus, the stapling force required increases rapidly as the thickness of the sheaf of papers increases. Consequently, a comparatively strong, and thus expensive, motor is needed for driving the arm 5. Naturally, also the other components have to be dimensioned to withstand considerable stresses, which renders the stapler expensive as well as bulky.

The object of the present invention is to obviate the above drawbacks and provide a stapler in which the stapling force increases comparatively slowly as the thickness of the sheaf of papers increases, thereby enabling the use of a smaller and less expensive motor as well as other less expensive components.

SUMMARY OF THE INVENTION

According to the invention, this object is achieved by a stapler which is of the type stated by way of introduction and which is characterised in that the operating means is pivotably connected to the stapler head via the second pin, and that a locking mechanism is adapted to releasably lock the stapler head in the working position while a staple is being driven into said object.

Preferably, the locking mechanism has a locking plate which is pivotably connected to the stapler head via a third pin parallel to said pins and which has an arcuate slot in which engages a locking pin which is fixedly connected to the base and parallel to said pins.

In a preferred embodiment, the locking plate is pivotable between a first position, in which the locking pin is located in a first end portion of the arcuate slot, and a second position, in which the locking pin is located in a second end portion of the arcuate slot and towards which the locking plate is biased by a spring, said arcuate slot having, with respect to the third pin, a radius of curvature increasing in the direction away from the first end portion towards the second end portion, said third pin being so positioned in relation to the first pin that, when the spring pivots the locking plate from the first position to the second position and the distance of the third pin to the locking pin fixedly connected to the base thus increases as a result of the increase of the radius of curvature of the slot, it moves the stapler head to the working position in which it is locked by a wedge action between the wall of the slot and the locking pin.

Preferably, the drive means has a motor-driven driving gear wheel whose axis coincides with that of the first pin, and a cam mechanism which is rotatably mounted on the stapler head via a fourth pin parallel to said pins, meshes, via a gear wheel, with the driving gear wheel to be driven thereby, and has a first cam means adapted to cooperate with the operating means so as to pivot, when the cam mechanism is rotated, the operating means to and fro about the second pin, thereby reciprocating the drive element.

Preferably, the cam mechanism has a second cam means adapted to cooperate with the locking plate in order, when the cam mechanism is in a starting position, to retain the locking plate in its first position; in order, when the cam mechanism in the initial phase of a revolution is rotated away from its starting position, to release the locking plate so that it is pivoted to its second position by the spring; and in order, when the cam mechanism in the final phase of said revolution returns to its starting position, to return the locking plate to its first position against the action of the spring, said first and second cam means being so synchronised that the operating means, as well as the locking plate, performs a pivotal cycle during one revolution of the cam mechanism and that the operating means imparts a driving stroke to the drive element when the second cam means has released the locking plate and this is in its second position, thereby locking the stapler head in the working position.

BRIEF DESCRIPTION OF THE DRAWINGS

The invention will now be described in more detail with reference to the accompanying drawings, in which.

DESCRIPTION OF THE PREFERRED EMBODIMENTS

Figure 1:
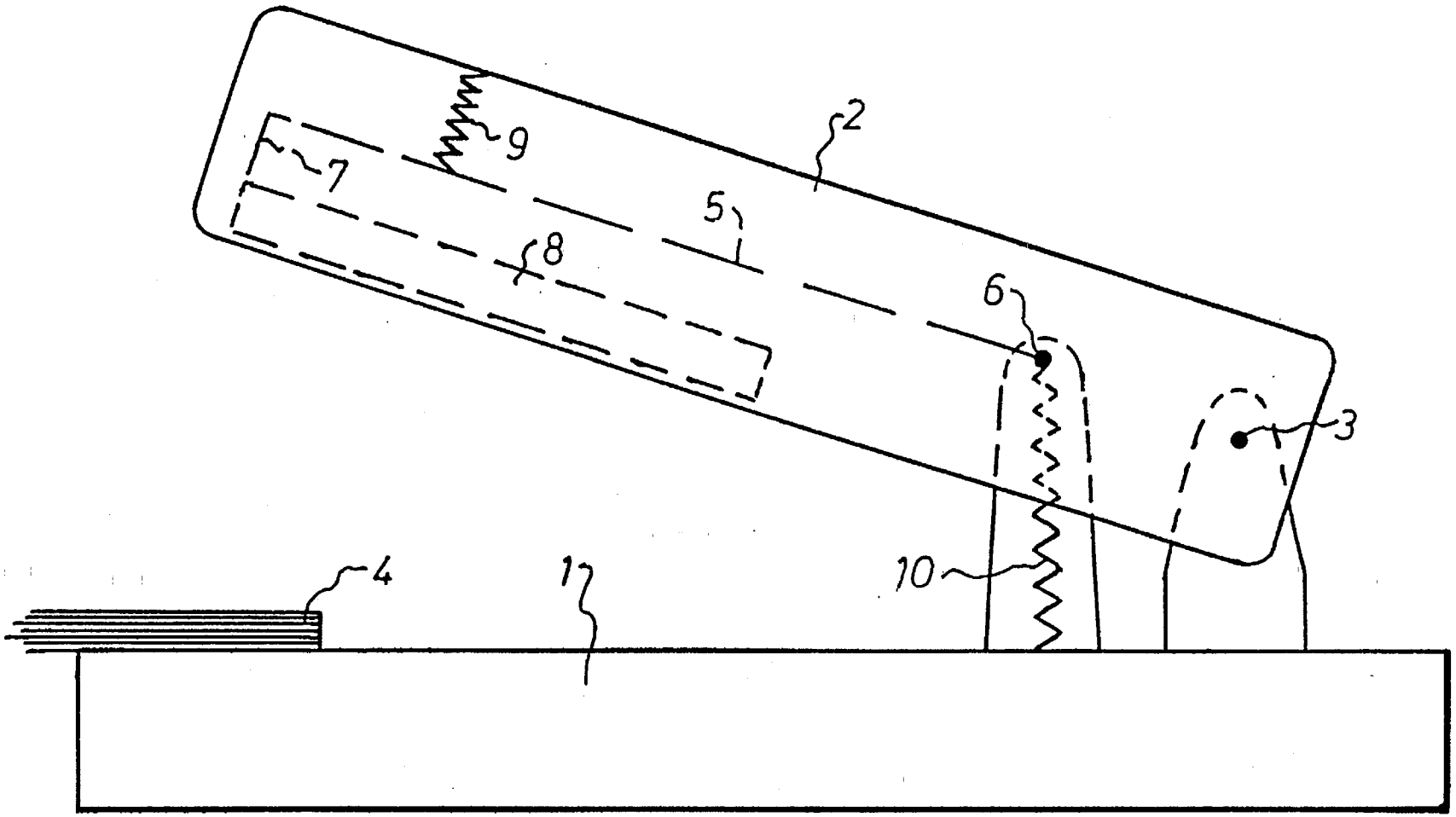
FIG. 1 PRIOR ART
FIG. 1 is a schematic view of the prior-art stapler described above.
Figure 2:
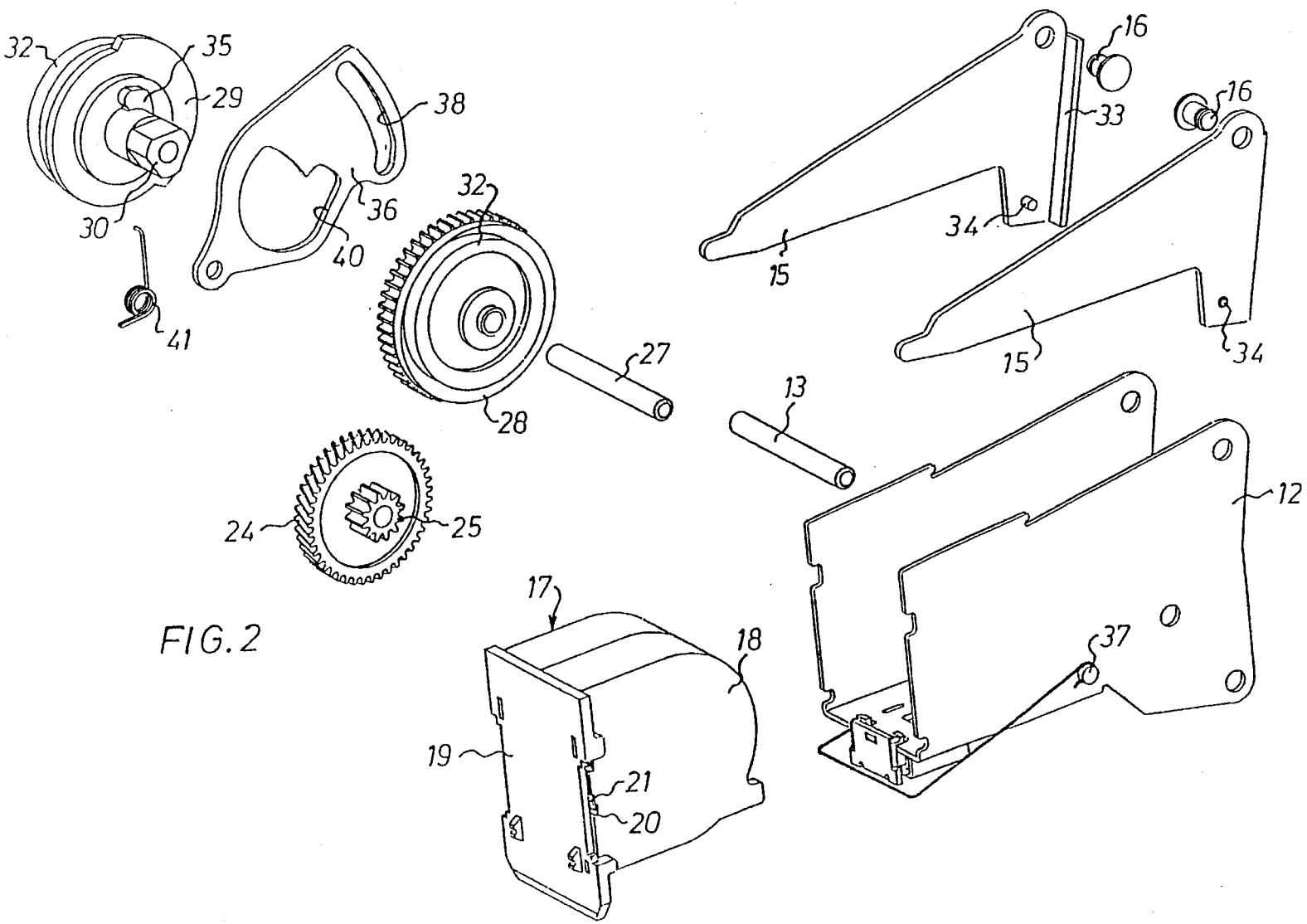
FIG. 2 is an exploded perspective view showing parts of a stapler according to the invention.
Figure 3:
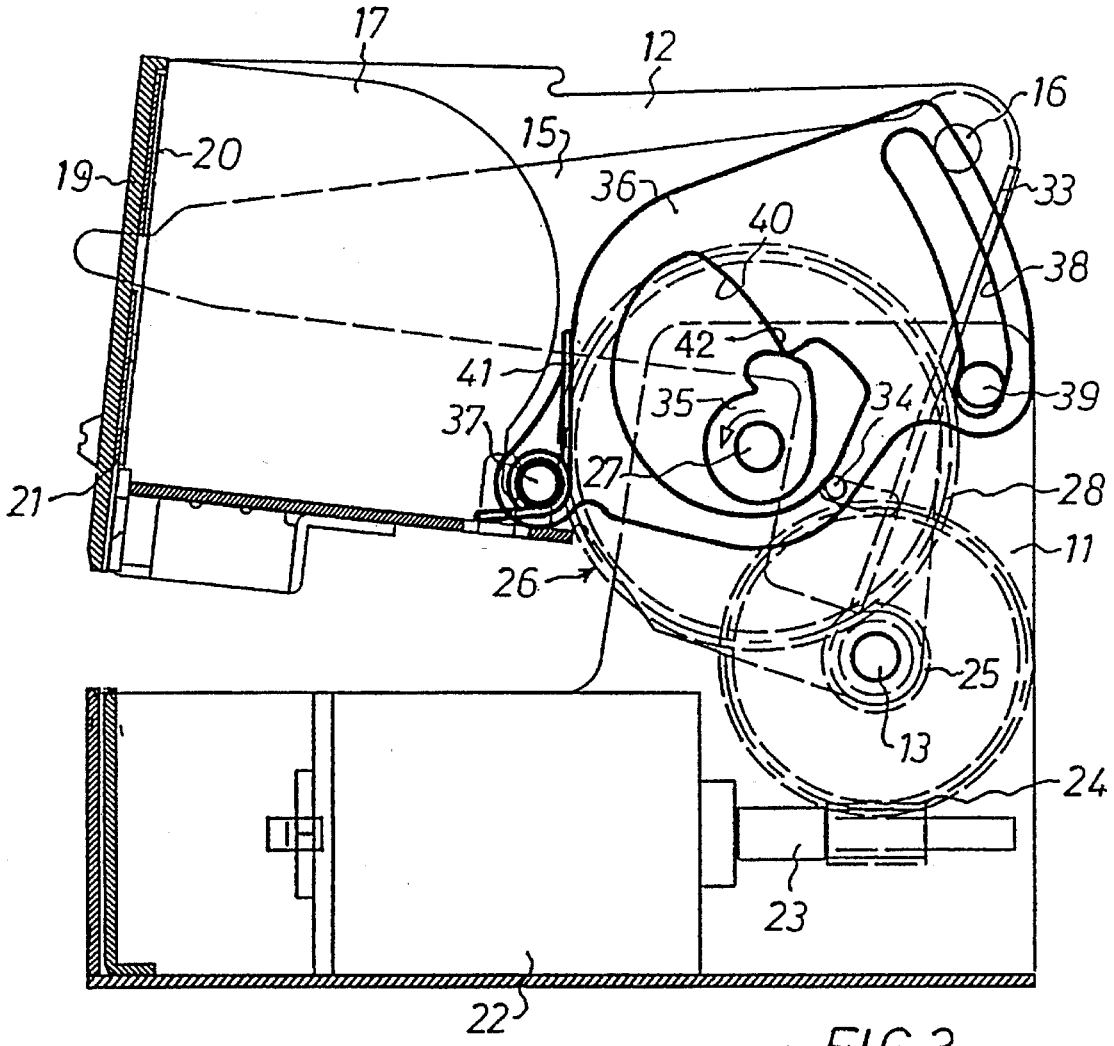
FIGS. 3–5 are longitudinal sections showing the stapler in different operative positions.
Figure 4:
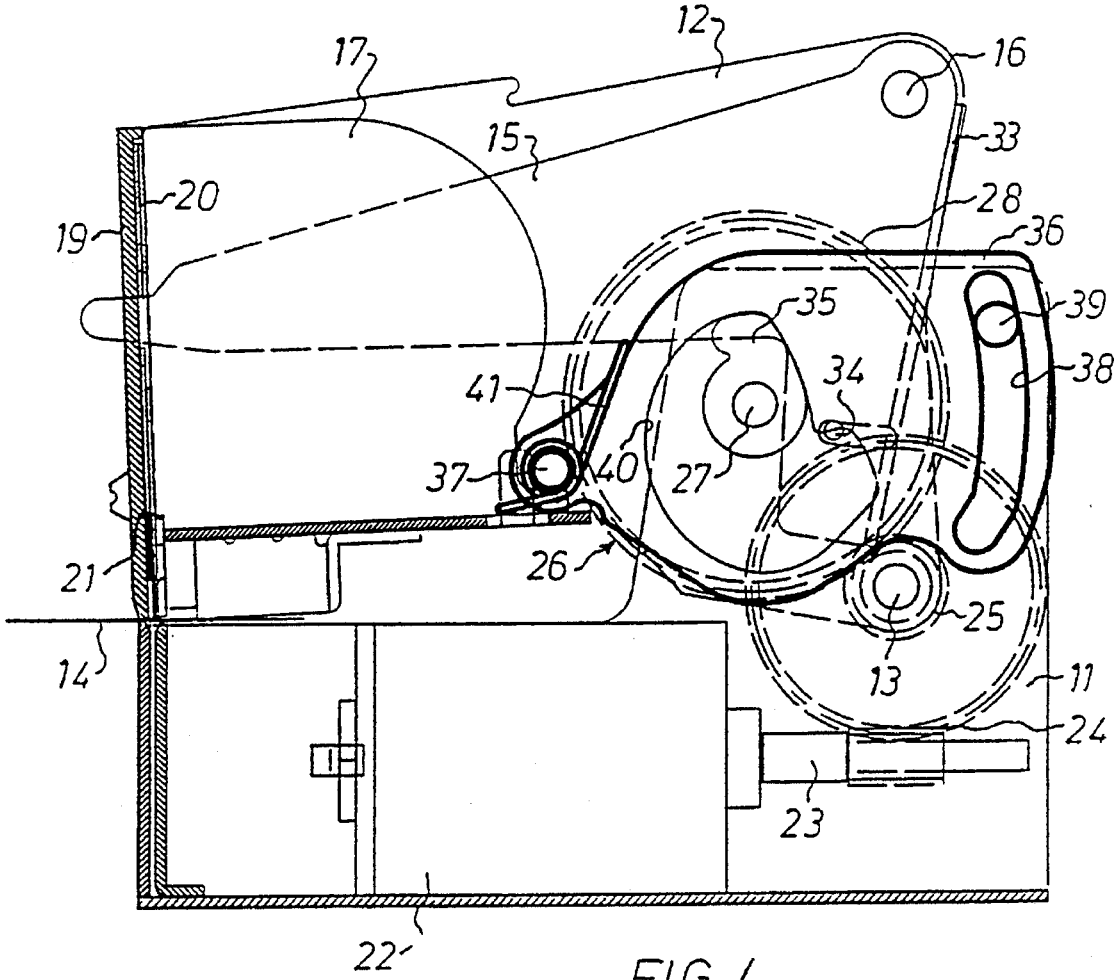
Figure 5:
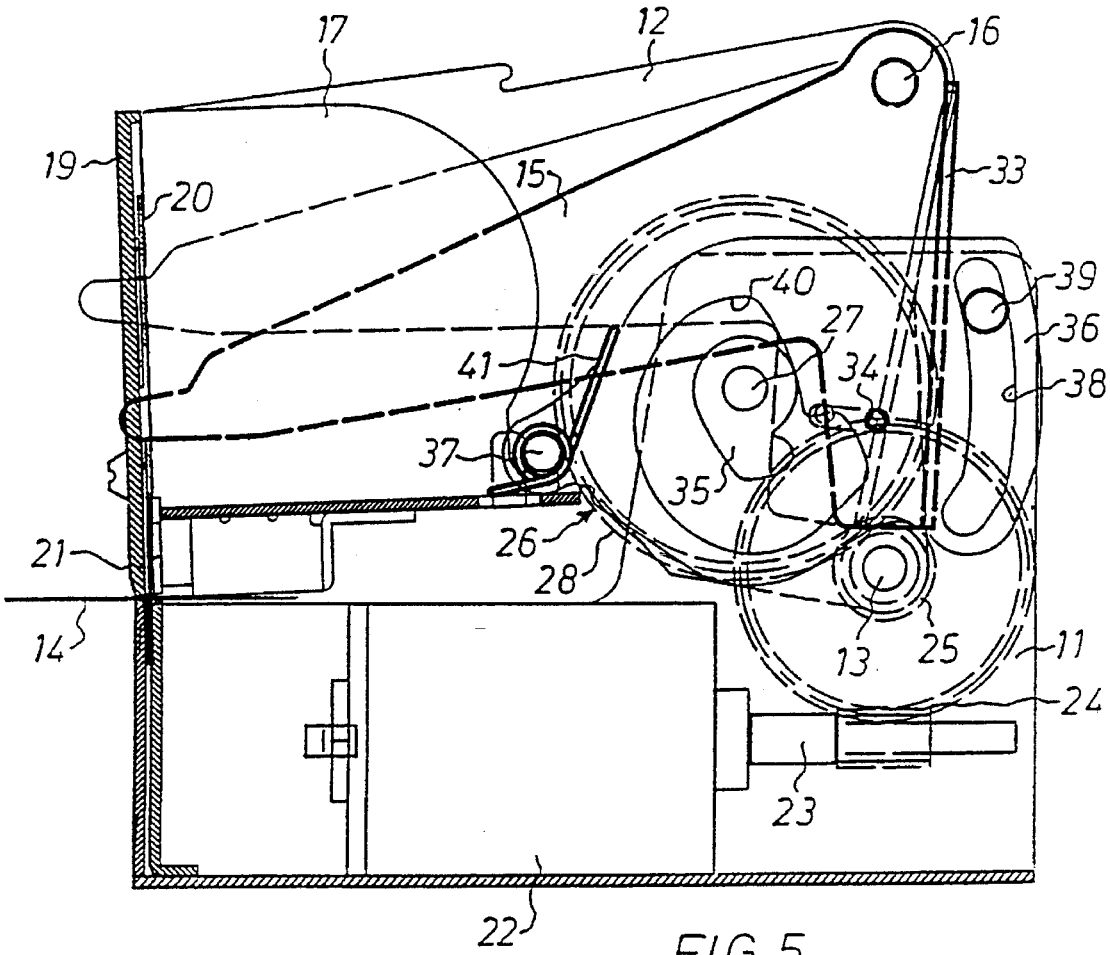

The stapler illustrated in FIGS. 2–7 is electrically operated and comprises a fixed base 11 and a stapler head 12 pivotably connected to the base 11. The stapler head 12 is pivotable about a transverse pin 13 between an upper starting position (see FIG. 3) and a lower working position in which the stapler head 12 is applied against a sheaf of papers 14 placed in the stapler between the base 11 and the stapler head 12. The lower working position is shown in FIGS. 4 and 5 for a sheaf 14 comprising but two sheets of paper, and in FIGS. 6 and 7 for a much thicker sheaf 14 containing a large number of sheets. Thus, the working position of the stapler head 12 depends on the thickness of the sheaf of papers 14.

The stapler head 12 is a U-shaped channel (see FIG. 2) in which there is provided a drive mechanism in the form of two arms 15. At the rear end, the arms 15 are each pivotably connected to a side wall of the U-shaped channel. The arms 15 extend forwards in parallel with the side walls and project, at the front end, a certain distance beyond the stapler head 12. The arms 15 are each pivotable about a transverse pivot pin 16 fixed to a channel side wall. The pivot pins 16 are located opposite to one another and are parallel to the pin 13. The arms 15 are pivotable in relation to the stapler head 12 between an upper starting position (see FIGS. 3, 4 and 6) and a lower turning position (see FIGS. 5 and 7).

A magazine 17 containing staples or staple blanks (not shown) is mounted in the front portion of the stapler head 12. In this case, the magazine is a cassette of the type described in the co-pending PCT Application SE93/00165 entitled "Cassette for Use in a Stapler". The cassette 17 has a casing 18 containing straight wire blanks which are juxtaposed and releasably interconnected to form a strip of staple blanks, which is rolled up into a roll (not shown). The cassette 17 also has a front plate 19 in which a staple shaper 20 and a staple driver 21 are arranged in reciprocating fashion. At the front portion, the arms 15 engage the staple shaper 20 and the staple driver 21 so as to reciprocate these upwards and downwards during their pivotal movement. When the arms 15 are being swung downwards, the staple shaper 20 and the staple driver 21 are moved downwards, and the staple shaper 20 bends a staple blank into a U-shaped staple while the staple driver 21 releases the U-shaped staple formed by the staple shaper 20 during the preceding stapling cycle and drives this staple into the sheaf of papers 14. Naturally, this takes place when the stapler head 12 is in working position, i.e. applied against the sheaf of papers 14.

As mentioned in the foregoing, the stapler is electrically operated, and is driven by an electric motor 22 provided in the base 11. Via a worm gear 24, the output shaft 23 of the motor 22 drives a driving gear wheel 25. The wheel 25 is rotatably mounted on the pin 13 which is connected to the base 11 and about which the stapler head 12 pivots. The driving gear wheel 25 is adapted to drive a cam mechanism 26 provided in the stapler head 12 and rotatably mounted on a pin 27 which is parallel to the pin 13 and connected to the stapler head. To this end, the driving gear wheel 25 meshes with a gear wheel 28 forming part of the cam mechanism 26 and mounted on the pin 27. In addition to the gear wheel 28, the cam mechanism 26 includes a cam wheel 29 which is non-rotatably connected to the gear wheel 28. The gear wheel 28 and the cam wheel 29 are interconnected by a hub portion 30 which is provided on the cam wheel 29 and has a non-circular cross-section and which is inserted in a centre hole provided in the gear wheel 28 and having a corresponding cross-sectional shape.

The gear wheel 28 and the cam wheel 29 each have an annular cam curve 32 with a cam surface facing radially outwards and a cam surface facing radially inwards. The cam curves 32 are identical and cooperate with the respective arms 15 so as to pivot, when the cam mechanism 26 rotates, the arms 15 in synchronised manner between the upper starting position and the lower turning position. The outward cam surface then cooperates with a rear flange 33 on the respective arms 15, while the inward cam surface cooperates with a pin 34 connected to the respective arms 15 and located slightly ahead of the flange 33.

The hub portion 30 has a cam means 35, non-rotatably connected thereto, of pear-like cross-sectional shape. The cam means 35 has a first portion which extends throughout most of its circumference and has a constant radius with respect to the pin 27, as well as a second portion which extends throughout a much smaller part of its circumference and also has a constant radius. As appears from FIGS. 3–7, the radius of the second portion is much larger than that of the first portion.

A locking plate 36 parallel to the side walls of the stapler head 12 is pivotably connected to the stapler head 12. The locking plate 36 is pivotable about a pin 37 parallel to the pins 13 and 27 and fixed in the lower portion of the stapler head 12 at a considerable distance ahead of the pivot pin 13 of the stapler head 12. Also, the locking plate 36 has an arcuate slot 38 in which engages a locking pin 39 parallel to the pins 13, 27 and 37. The locking pin 39 is fixedly connected to the base 11 at the upper rear portion thereof (behind and above the pin 13). At the centre, the locking plate 36 has a hole 40 of a special shape. The hub portion 30 of the cam mechanism 26 extends through the hole 40, and the cam means 35 on the hub portion 30 is located axially opposite to the locking plate 36 so as to cooperate with the boundary wall of the hole 40, as shown in FIGS. 3–7.

The locking plate 36 is pivotable between an upper first position (see FIG. 3) in which the locking pin 39 is located in a lower first end portion of the arcuate slot 38, and a lower second position which depends on the thickness of the sheaf of papers 14 (see FIGS. 4 and 5 for a thin sheaf, and FIGS. 6 and 7 for a thick sheaf) and in which the locking pin 39 is located in an upper second end portion of the arcuate slot 38. The locking plate 36 is biased towards the second position by a spring 41 mounted on the pin 37 between the bottom of the stapler head 12 and the front edge of the locking plate 36. With respect to the pin 37, the arcuate slot 38 has a radius of curvature increasing in the direction away from the lower first end portion towards the upper second end portion. First, the radius of curvature increases considerably throughout a small part of the length of the slot 38, and then increases slowly throughout the remainder of the slot length. The reason for this will be explained in more detail below.

The function of the stapler will now be described in more detail with reference to FIGS. 3–8.

In starting position (see FIG. 3), the stapler head 12 is in its upper position and the cam mechanism 26 occupies such a rotational position that the cam curves 32 maintain the arms 15 in their upper positions and that the second (large-radius) portion of the cam means 35 is applied against a projection 42 on the boundary wall surrounding the hole 40 in the locking plate 36 and maintains the locking plate 36 in the upper first position, so that the spring 41 is unable to urge the locking plate 36 to the lower second position.

When a sheaf of papers 14 is placed in the stapler, a microswitch (not shown) is actuated and starts the motor 22. Then, the motor 22 rotates the gear wheel 28, which engages the driving gear wheel 25, and consequently the entire cam mechanism 26, one turn anticlockwise with respect to FIGS. 3–8. When the cam mechanism 26, and consequently the cam means 35, has been turned through about 15°, the cam means releases the locking plate 36, which then is moved to its lower second position (see FIG. 4) by the spring 41. Since the arcuate slot 38 has a radius of curvature increasing in the direction away from the lower first end portion towards the upper second end portion with respect to the pin 37, the distance between the locking pin 39 and the pin 37 has to increase while the locking plate 36 is swung downwards. This increase in distance is achieved by the pin 37, connected to the stapler head 12, pivoting the stapler head 12 downwards to the working position (see FIG. 4). Since the locking pin 39, during the pivotal movement of the locking plate 36 from the upper first position to the lower second position, first passes the short slot portion where the increase in radius of curvature is considerable, the stapler head 12 is initially swung downwards quite rapidly. This rapid downward movement takes place in an area where the stapler head 12 does not run the risk of hitting a sheaf of papers 14, i.e. in an area located above the thickest sheaf that can be placed in the stapler.

The stapler head 12 is locked in the working position since it cannot be swung upwards about the pivot pin 13 because the increase of the radius of curvature of the arcuate slot 38 is so chosen with respect to the material (preferably hardened steel) of which the locking plate 36 and the locking pin 39 are made, that a locking wedge action occurs between the wall of the slot 38 and the locking pin 39.

Figure 8:
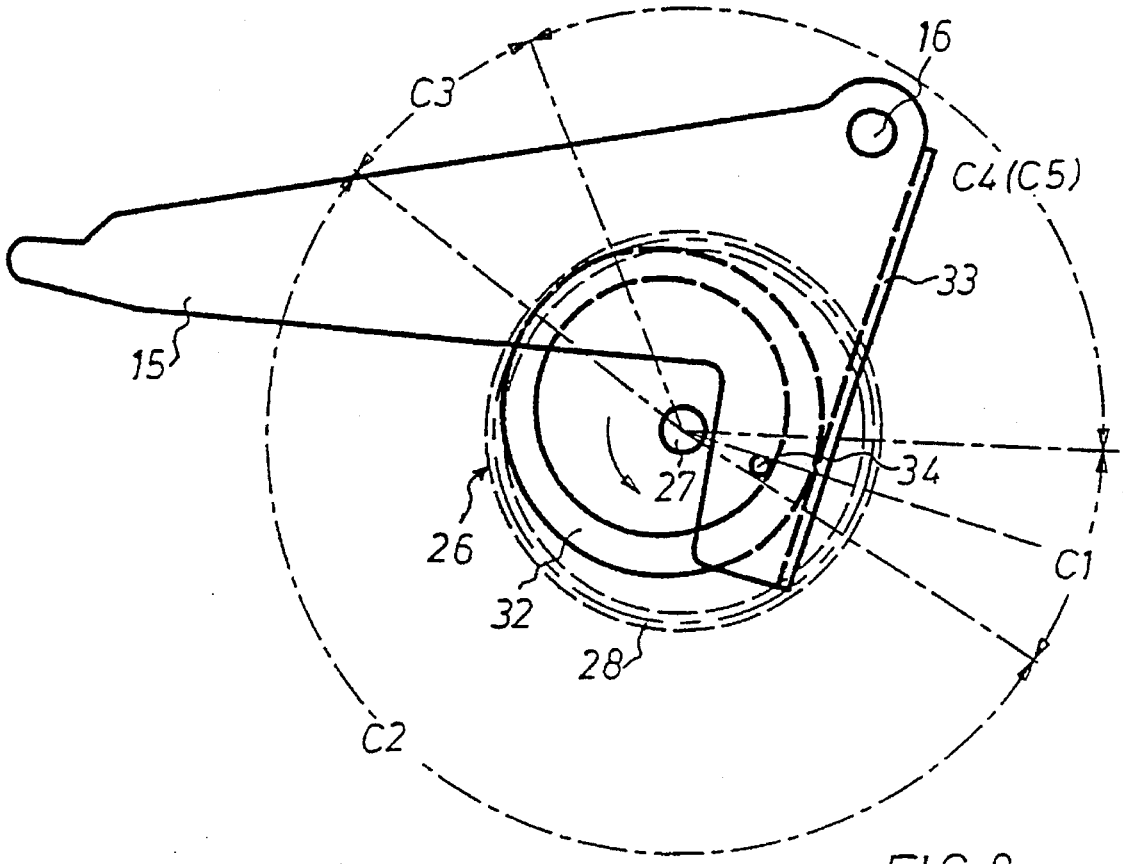
FIG. 8 shows parts of a cam mechanism.

During the initial rotation of the cam mechanism 26, the cam curves 32 are applied against the flanges 33 of the respective arms 15 by a first circumferential portion C1 of constant radius with respect to the pin 27 and an extent of about 30° (see FIG. 8). As a result, the arms 15 are still located in the upper starting position in relation to the stapler head 12 when the latter reaches the sheaf of papers 14 (see FIG. 4).

During the continued rotation of the cam mechanism 26, the cam curves 32 come to be applied against the flanges 33 of the respective arms 15 by a second circumferential portion C2 of slightly increasing radius with respect to the pin 27 and an extent of about 180°. When the cam mechanism 26 is being further rotated, the arms 15 are thus swung downwards to the lower turning position, in which they have moved the staple shaper 20 and the staple driver 21 to their lower positions. This means that the staple driver 21 is situated quite close to the uppermost sheet in the sheaf of papers 14.

When the cam mechanism 26 is being further rotated, the cam curves 32 come to be applied against the flanges 33 of the respective arms 15 by a third circumferential portion C3 of constant radius so as to maintain the arms 15, and consequently the staple shaper 20 and the staple driver 21, in their lower positions during a clinching operation (not described in detail here) for bending the legs of the inserted staple against the underside of the sheaf of papers 14. The third circumferential portion C3 has an extent of about 25° and merges into a fourth circumferential portion C4 which has a decreasing radius and smoothly merges into the first circumferential portion C1. The above-mentioned portions are the circumferential portions of the radially-outwards-facing surfaces of the respective cam curves 32. The surface of the cam curves 32 that faces radially inwards has a circumferential portions C5 which is located opposite to the fourth outward circumferential portion C4 and which has a decreasing radius with respect to the pin 27 so as to return the arms 15 to the upper starting position in cooperation with the respective pins 34.

In the final stage of the revolution of the cam mechanism 26, i.e. when the arms 15 are returned to the upper starting position, the second (large-radius) portion of the cam means 35 encounters the projection 42 and returns the locking plate 36 to its upper first position against the action of the spring 41. The stapler head 12 is swung to its upper position owing to the decrease of the radius of curvature of the arcuate slot 38 in the direction away from its upper second end portion towards its lower first end portion.

Figure 6:
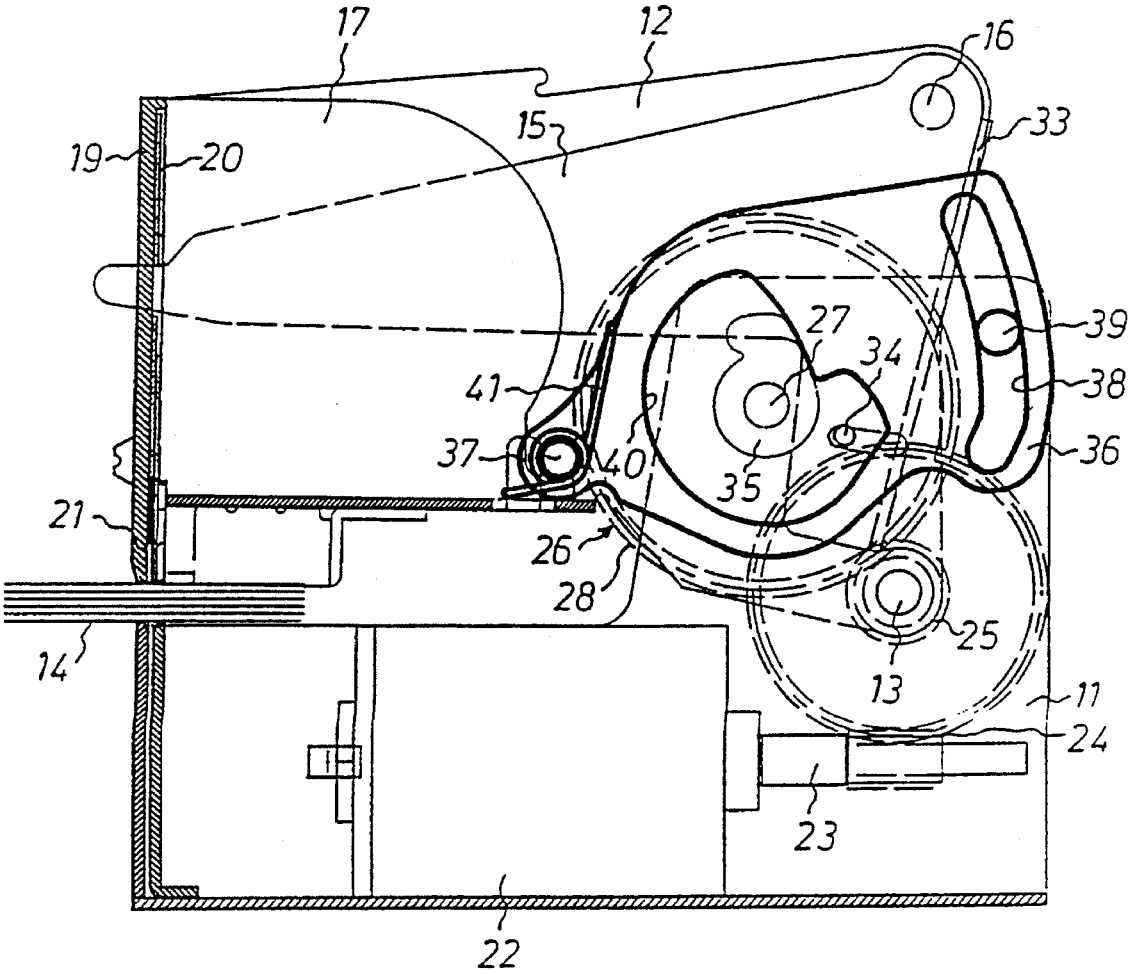
FIGS. 6 and 7 are similar to FIGS. 4 and 5, respectively, but illustrate the stapling of a thicker sheaf of papers.
Figure 7:
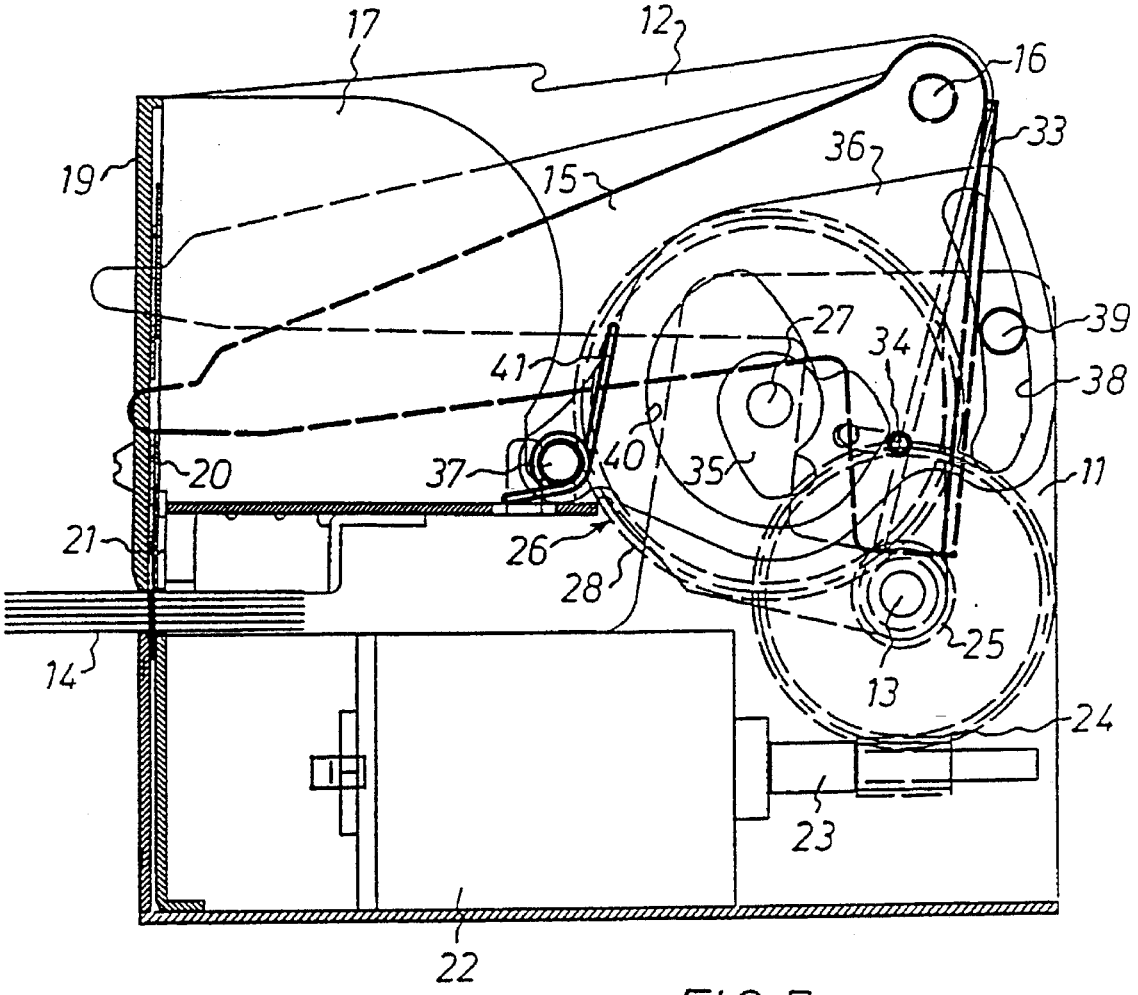

FIGS. 6 and 7 (similar to FIGS. 4 and 5, respectively) show a thicker sheaf of papers 14. A thick sheaf and a thin sheaf are stapled in exactly the same way, except that the stapler head 12, when a thicker sheaf of papers 14 is to be stapled, is swung downwards a shorter distance before being applied against the sheaf. This only means that the locking plate 36 is also swung downwards a shorter distance by the spring 41. The downward movement of the locking plate 36 is, however, sufficient to make the locking pin 39 reach into that portion of the arcuate slot 38 where the radius of curvature increases slowly and the stapler head 12 is thus locked in swung-down position. The pivotal movement of the arms 15, taking place in relation to the stapler head 12, is not at all affected by the thickness of the sheaf of papers 14.

We claim:

1. A stapler for driving staples into an object (14), such as a sheaf of papers, said stapler comprising a base (11), a stapler head (12) pivotably connected to the base via a first pin (13) and pivotable between a starting position and a working position in which said stapler head is applied against said object when said object is placed in the stapler between the base and the stapler head, a reciprocating drive element (21) disposed in the stapler head (12) for driving a staple into said object (14), an operating means (15) which is pivotable about a second pin (16) parallel to the first pin (13) for reciprocating the drive element (21), and a drive means (22–26) for pivoting the stapler head (12) and the operating means (15), characterised in that the operating means (15) is pivotably connected to the stapler head (12) via the second pin (16), and that a locking mechanism (36–41) is provided to releasably lock the stapler head (12) in the working position while a staple is being driven into said object.

2. A stapler as set forth in claim 1, characterised in that the locking mechanism (36–41) has a locking plate (36) which is pivotably connected to the stapler head (12) via a third pin (37) parallel to said first and second pins (13, 16) and which has an arcuate slot (38) which engages a locking pin (39) which is fixedly connected to the base (11) and parallel to said first, second and third pins (13, 16, 37).

3. A stapler as set forth in claim 2, characterised in that the locking plate (36) is pivotable between a first position, in which the locking pin (39) is located in a first end portion of the arcuate slot (38), and a second position, in which the locking pin (39) is located in a second end portion of the arcuate slot (38) and towards which the locking plate (36) is biased by a spring (41), said arcuate slot (38) having, with respect to the third pin (37), a radius of curvature increasing in the direction away from the first end portion towards the second end portion, said third pin (37) being so positioned in relation to the first pin (13) that, when the spring (41) pivots the locking plate (36) from the first position to the second position and the distance of the third pin (37) to the locking pin (39) fixedly connected to the base (11) thus increases as a result of the increase of the radius of curvature of the slot (38), the spring moves the stapler head (12) to the working position in which said stapler head is locked by a wedge action between a wall of the slot (38) and the locking pin (39).

4. A stapler as set forth in claim 3, characterised in that the drive means (22–26) has a motor-driven driving gear wheel (25) whose axis coincides with that of the first pin (13), and a cam mechanism (26) which is rotatably mounted on the stapler head (12) via a fourth pin (27) parallel to said first, second and third pins (13, 16, 37), and meshes, via a gear wheel (28), with the driving gear wheel (25) to be driven thereby, said cam mechanism has a first cam means (32) adapted to cooperate with the operating means (15) so as to pivot, when the cam mechanism (26) is rotated, the operating means to and fro about the second pin (16), thereby reciprocating the drive element (21).

5. A stapler as set forth in claim 4, characterised in that the cam mechanism (26) has a second cam means (35) adapted to cooperate with the locking plate (36) in order, when the cam mechanism (26) is in a starting position, to retain the locking plate (36) in its first position; in order, when the cam mechanism (26) in the initial phase of a revolution is rotated away from its starting position, to release the locking plate (36) so that the locking plate is pivoted to its second position by the spring (41); and in order, when the cam mechanism (26) in the final phase of said revolution returns to its starting position, to return the locking plate (36) to its first position against the action of the spring (41), said first and second cam means (32 and 35, respectively) being so synchronised that the operating means (15), as well as the locking plate (36), performs a pivotal cycle during one revolution of the cam mechanism (26) and that the operating means (15) imparts a driving stroke to the drive element (21) when the second cam means (35) has released the locking plate (36) and this is in its second position, thereby locking the stapler head (12) in the working position.

* * * * *